US007367782B2

(12) United States Patent
Kajita

(10) Patent No.: US 7,367,782 B2
(45) Date of Patent: May 6, 2008

(54) PUMP PLATE OF A ROTARY FEED PUMP

(75) Inventor: Hidenori Kajita, Kariya (JP)

(73) Assignee: Denso Corporation (JP)

( * ) Notice: Subject to any disclaimer, the term of this patent is extended or adjusted under 35 U.S.C. 154(b) by 737 days.

(21) Appl. No.: 10/801,001

(22) Filed: Mar. 16, 2004

(65) Prior Publication Data

US 2004/0191074 A1 Sep. 30, 2004

(30) Foreign Application Priority Data

Mar. 31, 2003 (JP) ..... 2003-095739

(51) Int. Cl.
*F04B 24/12* (2006.01)

(52) U.S. Cl. ..... 417/206; 418/171; 418/166

(58) Field of Classification Search ..... 417/206; 418/171, 166, 31, 24, 25, 26, 27
See application file for complete search history.

(56) References Cited

U.S. PATENT DOCUMENTS

| | | | | |
|---|---|---|---|---|
| 2,147,928 | A | 2/1939 | Seagren | |
| 2,764,941 | A * | 10/1956 | Miller et al. | 418/22 |
| 2,780,170 | A * | 2/1957 | Stoyke et al. | 417/203 |
| 3,695,791 | A * | 10/1972 | Brundage | 418/131 |
| 2003/0044288 | A1 | 3/2003 | Utsumi | |

FOREIGN PATENT DOCUMENTS

| | | |
|---|---|---|
| DE | 932283 | 8/1955 |
| DE | 198 42 016 A1 | 3/2000 |
| FR | 825418 | 3/1938 |
| FR | 1419672 | 12/1965 |
| FR | 1478077 | 4/1967 |
| JP | 63-113193 | 5/1988 |
| JP | 3-78985 | 8/1991 |
| JP | 04-224291 | 8/1992 |
| JP | 7-279790 | 10/1995 |
| JP | 2002-70756 | 3/2002 |
| JP | 2002-364479 | 12/2002 |
| JP | 2003-148295 | 5/2003 |
| WO | WO 03/048580 | 6/2003 |

OTHER PUBLICATIONS

Japanese Office Action dated Jun. 6, 2006.

* cited by examiner

*Primary Examiner*—Devon C. Kramer
*Assistant Examiner*—Vikansha Dwivedi
(74) *Attorney, Agent, or Firm*—Nixon & Vanderhye PC

(57) ABSTRACT

In a pump plate (26) of a feed pump, an inlet port (26*b*) and an outlet port (26*c*) are formed around a shaft hole (26*a*) through which a driving shaft is inserted, and a rib (26*f*), which partitions each of the inlet port (26*b*) and the outlet port (26*c*) in the circumferential direction thereof and connects opposite sides (an inner peripheral side and an outer peripheral side) of each of the inlet port (26*b*) and the outlet port (26*c*), is provided. Namely, each of the inlet port (26*b*) and the outlet port (26*c*) is divided into two portions in the circumferential direction thereof, by the rib (26*f*).

Therefore, when the feed pump is fastened to a side face of a pump housing by bolts, even if the thickness of the pump plate (26) is not increased, the deformation of the center of the pump plate (26) can be prevented.

2 Claims, 3 Drawing Sheets

(PRIOR ART) Fig.4
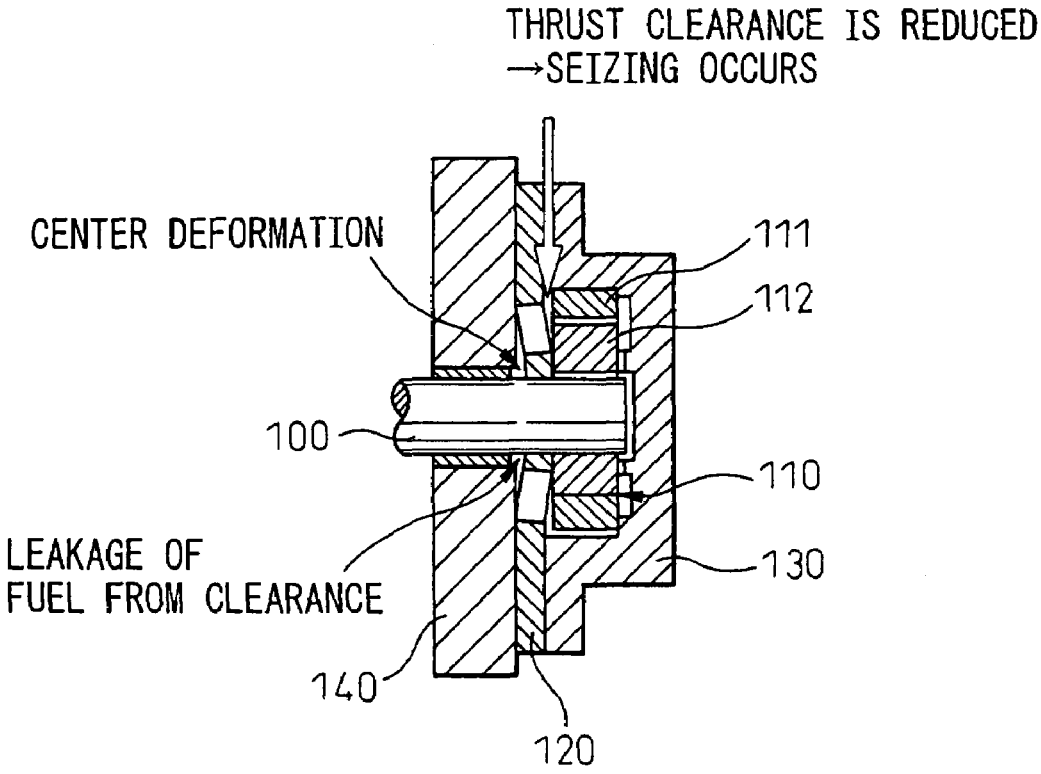
(PRIOR ART) Fig.5
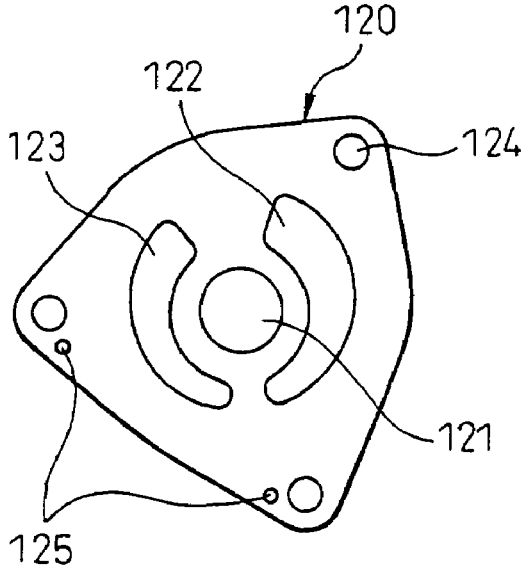

PUMP PLATE OF A ROTARY FEED PUMP

BACKGROUND OF THE INVENTION

1. Field of the Invention

The present invention relates to a feed pump attached to a fuel injection pump applied to, for example, a diesel engine.

2. Description of the Related Art

There is, as a prior art, for example, a fuel injection pump described below.

The fuel injection pump is provided with a feed pump that draws fuel from a fuel tank and supplies the same to an injection pump main body.

As shown in FIG. 4, the feed pump is composed of a pump element 110 rotated by a driving shaft 100, a pump plate 120 disposed at one end side of the pump element 110 in the axial direction thereof, and a pump cover 130 that covers the other end side of the pump element 110 in the axial direction thereof and an outer periphery of the pump element in the radial direction thereof, and that is combined with the pump plate 120 in a liquid-tight manner; and is fastened to a housing 140 of the injection pump main body by bolts.

The pump element 110 is a trochoid-type pump in which an inner gear 112 having outer teeth is disposed inside an outer gear 111 having inner teeth.

As shown in FIG. 5, in the pump plate 120, a shaft hole 121, through which the driving shaft 100 is inserted, is formed at the center of the plate, and an inlet port 122 and an outlet port 123 that are shaped like an arc are formed around the shaft hole 121. Further, bolt holes 124 and positioning holes 125 are formed on the outer periphery of the pump plate 120.

The pump cover 130 has an outer shape identical to that of the pump plate 120. In the cover, bolt holes and positioning holes are formed in a manner similar to the pump plate 120.

The above-described feed pump is fastened to the housing 140 by inserting a bolt (not shown) into each bolt hole 124 of the pump plate 120 and the pump cover 130, and threading the bolt into a threaded hole (not shown) formed in a side face of the housing 140. At this time, as shown in FIG. 4, the center of the pump plate 120 is sometimes deformed toward-the pump element 110. As a result, there is a possibility that the drawbacks (1), (2) described below may be caused.

(1) A thrust clearance between the pump plate 120 and the pump element 110 is reduced, so that seizing occurs.

(2) Leakage of fuel occurs at the deformed portion of the pump plate 120, so that a low-speed discharging property is reduced.

The deformation of the center of the pump plate 120 is caused by the reduction of rigidity of the pump plate 120 because of the large (long) inlet port 122 and outlet port 123 that are formed around the shaft hole 121 in the circumferential direction of the shaft hole. Therefore, the increase of the thickness of the pump plate to increase the rigidity of the pump plate 120 can be taken into consideration. However, in this case, demerits such as the increase of material cost, the increase of the size of the pump and the reduction of workability in pressing, occur. Accordingly, a method that causes the thickness of the pump plate 120 to be increased is not required.

SUMMARY OF THE INVENTION

In view of the above circumstances, the object of the present invention is to provide a fuel injection pump provided with a feed pump that can prevent the deformation of the pump plate without increasing the thickness of the pump plate.

According to a first aspect of the present invention, there is provided a fuel injection pump provided with a feed pump which is attached to a housing side surface of a fuel injection pump main body and which draws fuel and supplies the same to the fuel injection pump main body, wherein the feed pump comprises a trochoid-type pump element which is rotated by a driving shaft; a pump plate disposed on one end side of the pump element in an axial direction thereof, said pump plate having, at its center, a shaft hole through which the driving shaft is inserted, and substantially arc-shaped fuel inlet and outlet ports around the shaft hole; and a pump cover which covers the other end side of the pump element in the axial direction thereof and an outer periphery of the pump element in the radial direction thereof, said pump cover being combined with the pump plate in a liquid-tight manner, said pump cover being fastened to the housing side surface, together with the pump plate wherein said pump plate is provided with a rib that partitions at least one of the inlet and outlet ports in a circumferential direction thereof, and couples the opposite sides of the port.

With the above structure, the rigidity of the pump plate is increased because a rib is added to the pump plate. Therefore, the deformation of the center of the plate can be prevented without increasing the thickness of the pump plate. Only one of the inlet port and the outlet port may be provided with the rib. However, it is needless to say that the rigidity can be further improved by providing the ribs in both of the inlet and outlet ports.

According to a second aspect of the present invention, there is provided a fuel injection pump, wherein the rib is provided substantially at a center of said at least one of the ports, in the circumferential direction thereof.

The inlet port and the outlet port extend in the circumferential direction of the shaft hole. Therefore, the rib is provided in the substantial center of the port in the circumferential direction, so that the rigidity of the pump plate can be effectively improved.

According to a third aspect of the present invention, there is provided a fuel injection pump, wherein the pump cover is fastened to the housing side surface by screws.

The present invention may be more fully understood from the description of preferred embodiments of the invention set forth below, together with the accompanying drawings.

BRIEF DESCRIPTION OF THE DRAWINGS

FIG. 4 is a sectional view of a conventional feed pump; and

FIG. 5 is a plan view of a conventional pump plate.

DESCRIPTION OF PREFERRED EMBODIMENTS

Embodiments of the present invention will be described below with reference to drawings.

Figure 1:
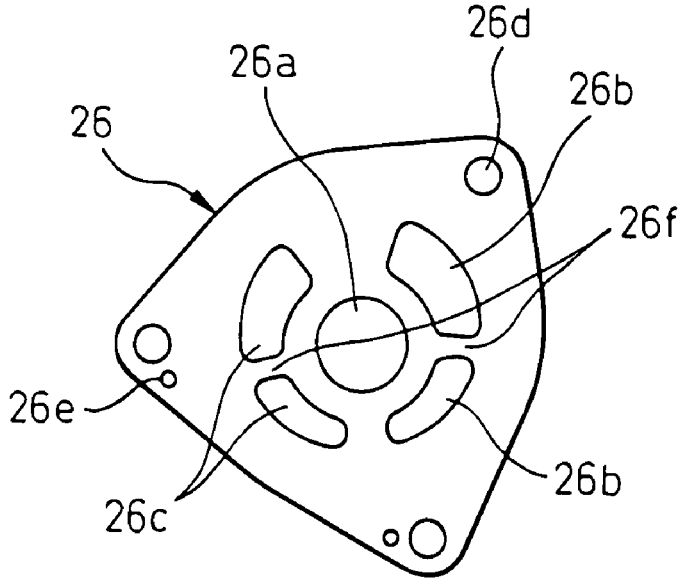
FIG. 1 is a plan view of a pump plate.
Figure 2:
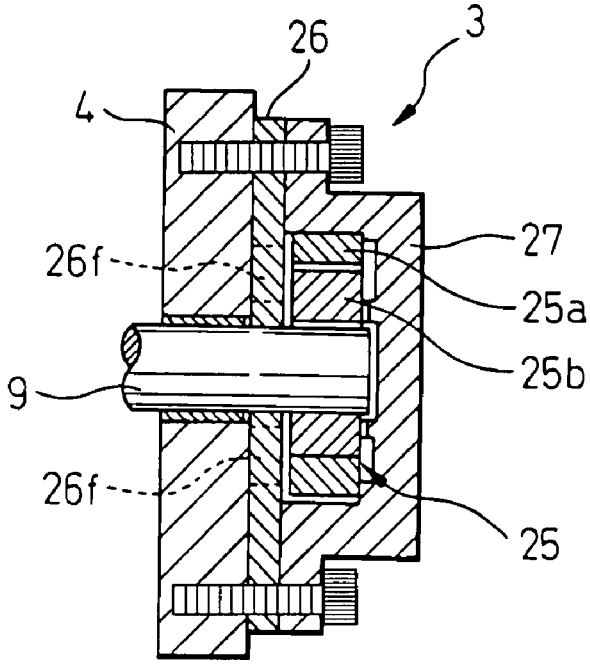
FIG. 2 is a sectional view of a feed pump.
Figure 3:
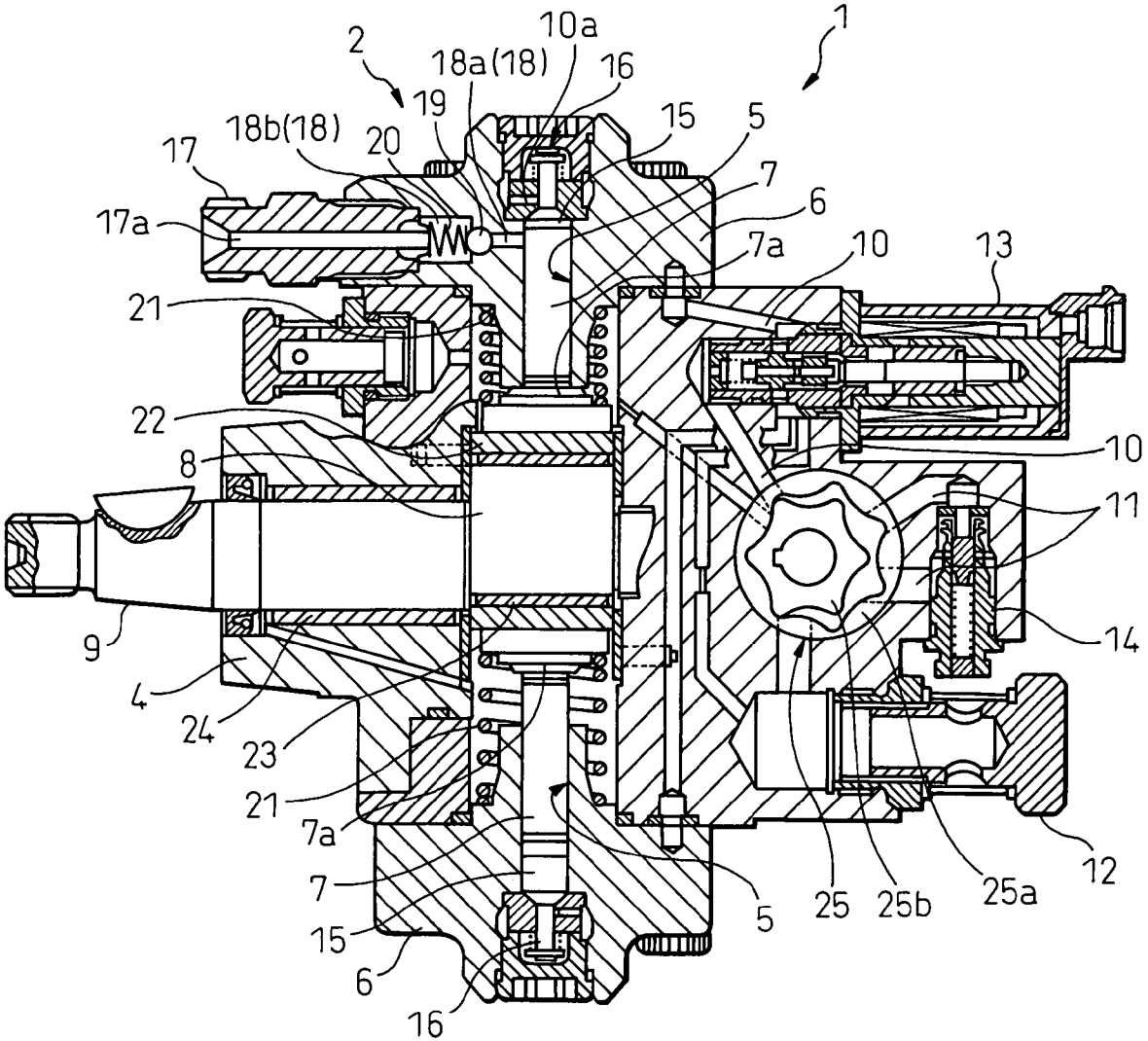
FIG. 3 is a sectional view of a fuel injection pump.

FIG. 1 is a plan view of a pump plate used for a feed pump. FIG. 2 is a sectional view of a feed pump. FIG. 3 is a sectional view of a fuel injection pump.

A fuel injection pump 1 of the present embodiment is used for, for example, an accumulator fuel injection system for a diesel engine, and is provided with an injection pump main body 2 which pressurizes fuel to deliver the same and a feed pump 3 (see FIG. 2) which draws fuel from a fuel tank (not shown) and supplies the same to the injection pump main body, as shown in FIG. 3.

a) The injection pump main body 2 is composed of a pump housing 4, cylinder heads 6 each defining a cylinder 5, plungers 7 each inserted into the cylinder 5, a driving shaft 9 which drives the plungers 7 via a cam 8, and the like.

In the pump housing 4, a fuel supplying passage 10 connected to an outlet port 26*c* (see FIG. 1) of the feed pump 3, a return passage 11 which branches off from the fuel supplying passage 10 and returns residual fuel to a fuel tank (not shown), etc. are formed, and a fuel inlet 12, an electromagnetic amount regulating valve 13 and a pressure regulating valve 14, etc. that will be described below are mounted.

The fuel inlet 12 connected to a fuel passage (not shown) which draws fuel from the fuel tank, filters the drawn fuel and introduces the filtered fuel to the feed pump 3.

The electromagnetic amount regulating valve 13 is provided in the fuel supplying passage 10, and regulates the amount of fuel delivered from the feed pump 3, in accordance with the state of running of the engine.

The pressure regulating valve 14 is provided in the return passage 11, and opens when the pressure of fuel in the feed pump 3 is equal to or more than a predetermined pressure.

The cylinder heads 6 are mounted to the pump housing 4, and are disposed at opposed two positions in the radial direction of the driving shaft 9. In each cylinder head 6, a check valve 16, by which a compression chamber is formed between the plunger 7 and the check valve in the cylinder 5, and a piping joint 17 are mounted, and a discharging passage 18 which discharges the fuel compressed by the compression chamber 15 is formed.

The check valve 16 which can open/close a space between the compression chamber 15 and a communicating passage 10*a* communicated with the fuel supplying passage 10, opens, in a downwardly moving process (a fuel drawing process) of the plunger 7, to introduce the fuel delivered to the feed pump 3 to the compression chamber 15, and closes, in an upwardly moving process (a fuel delivering process) of the plunger 7, to prevent the fuel drawn to the compression chamber 15 from returning to the feed pump 3.

A fuel passage 17*a* is formed inside the piping joint 17, and is communicated with a discharging passage 18.

The discharging passage 18 is composed of an inlet hole 18*a* having a small internal diameter and an outlet hole 18*b* having a large internal diameter. The inlet hole 18*a* is communicated with the inside of the cylinder 5, and the outlet hole 18*b* is communicated with the fuel passage 17*a* of the piping joint 17. A ball valve 19 is disposed between the inlet hole 18*a* and the outlet hole 18*b*, and is biased, by a spring 20, to interrupt a connection between the inlet hole 18*a* and the outlet hole 18*b*. The ball valve 19 opens in the upwardly moving process of the plunger 7, to communicate the inlet hole 18*a* and the outlet hole 18*b*.

The plunger 7 has a plunger head 7*a* on the side opposite to the compression chamber. The plunger head 7*a* is biased by a spring 21 and is pressed against a shoe 22. The rotation of the cam 8 is transferred to the shoe 22 via a bushing 23 provided between the shoe 22 and the cam 8, and the shoe 22 moves around the cam 8.

The driving shaft 9 is rotatably supported by the pump housing 4 via the bearing 24, and is driven by the engine, to rotate.

The cam 8 has a circular section. The cam 8 whose center is eccentric away from the center of the driving shaft 9, is integral with the driving shaft 9.

b) The feed pump 3 is composed of a pump element 25, a pump plate 26 and a pump cover 27, and is secured to a side face of the pump housing 4 (see FIG. 2).

As shown in FIG. 3, the pump element 25 is a known trochoid-type pump in which an inner gear 25*b* having outer teeth is disposed inside an outer gear 25*a* having inner teeth. The inner gear 25*b* is coupled to the driving shaft 9 by a key, and integrally rotates with the driving shaft.

As shown in FIG. 2, the pump plate 26 is disposed between the pump element 25 and the pump housing 4. As shown in FIG. 1, a shaft hole 26*a*, through which the driving shaft 9 is inserted, is formed at the center of the pump plate 26, and an inlet port 26*b* and an outlet port 26*c* are formed around the shaft hole 26*a*. A plurality of bolt holes 26*d* and positioning holes 26*e* are formed at an outer peripheral portion of the pump plate 26.

In the pump plate 26, there are provided ribs 26*f* which partition the inlet port 26*b* and the outlet port 26*c* in the circumferential directions thereof, respectively, and connect opposite sides (an internal diameter side and an outer diameter side) of the inlet port 26*b* and the outlet port 26*c*. Namely, the inlet port 26*b* and the outlet port 26*c* are divided into two portions in the circumferential directions thereof by the ribs 26*f*, respectively. The ribs 26*f* are provided substantially at centers of the inlet port 26*b* and the outlet port 26*c* in the circumferential directions thereof, respectively.

The pump cover 27 covers the side of the pump element 25 which is opposite to a side adjacent to the pump plate 26 in the axial direction of the pump element, and the outer periphery of the pump element in the radial direction thereof, and is combined with the pump plate 26 in a liquid-tight manner. The pump cover 27 has an outer shape identical to that of the pump plate 26. In the cover, a plurality of bolt holes and positioning holes are formed in a manner similar to the pump plate 26.

The above-described feed pump 3 is fastened to the pump housing 4 by inserting a bolt into each bolt hole 26*d* of the pump plate 26 and the pump cover 27, and threading the bolt into a threaded hole (not shown) formed in a side face of the pump housing 4.

The operation of the fuel injection pump 1 will be described below.

The rotation of the driving shaft 9 causes the cam 8 to rotate. The rotation of the cam 8 is transferred to the plunger 7 via the shoe 22 and, then the plunger 7 reciprocates in the cylinder 5. When the plunger 7 positioned at top dead center moves downwardly in the cylinder 5, the fuel discharged from the feed pump 3 is regulated in amount by the electromagnetic amount regulating valve 13 and, then, the regulated fuel flows from the fuel supplying passage 10 to the compression chamber 15 via the communicating passage 10*a* (at this time, the check valve 16 opens).

After that, when the plunger 7 which has reached bottom dead center moves upwardly again, toward the top dead center, in the cylinder 5, the check valve 16 closes so that the pressure of fuel is increased in the compression chamber 15. When the pressure of fuel in the compression chamber 15 overcomes the force of spring biasing the ball valve 19, the ball valve 19 is lifted to communicate the inlet hole 18*a* and the outlet hole 18*b* of the discharging passage 18. Consequently, the fuel pressurized in the compression chamber 15 is delivered to the fuel passage 17*a* of the piping joint 17 via the discharging passage 18 and, then is supplied to a common rail via a fuel piping connected to the piping joint 17.

The effect of the present embodiment will be described below.

In the feed pump 3 used in the fuel injection pump 1, the ribs 26*f* are provided substantially at centers of the inlet port 26*b* and the outlet port 26*c* in circumferential directions thereof, respectively. Therefore, as shown in FIG. 1, each of the inlet port 26*b* and the outlet port 26*c* is divided into two portions in the circumferential direction thereof. In the pump plate 26, the rigidity of the plate is improved in comparison with the conventional pump plate 120 shown in FIG. 5, because the rib 26*f* connects the inner peripheral side and the outer peripheral side of each of the inlet port 26*b* and the outlet port 26*c*.

Therefore, when the feed pump 3 is fastened to a side face of the pump housing 4 by bolts, even if the thickness of the pump plate 26 is not increased, the deformation of the center of the pump plate 26 can be prevented. Consequently, seizing of the feed pump 3 can be prevented because a predetermined thrust clearance can be ensured between the pump plate 26 and the pump element 25. Additionally, the leakage of fuel can be reduced, and the low-speed discharging property of the feed pump 3 can be maintained because the deformation of the pump plate 26 can be prevented.

In the present embodiment, the rib 26*f* is provided substantially at center of each of the inlet port 26*b* and the outlet port 26*c* in the circumferential direction thereof. However, the present invention is not limited to this. For example, at least one of the inlet port 26*b* and the outlet port 26*c* may be substantially divided into three portions by providing the ribs 26*f* at two positions. In this case, the number of the ribs 26*f* is determined in view of the increase of man-hours for dividing the inlet port 26*b* and the outlet port 26*c* and the improvement of rigidity of the pump plate 26.

While the invention has been described by reference to specific embodiments chosen for purposes of illustration, it should be apparent that numerous modifications could be made thereto by those skilled in the art without departing from the basic concept and scope of the invention.

The invention claimed is:

1. A fuel injection pump provided with a feed pump which is attached to a housing side surface of a fuel injection pump main body and which draws fuel and supplies the same to the fuel injection pump main body, wherein the feed pump comprises a trochoid-type pump element which is rotated by a driving shaft;

a pump plate disposed on one end side of the pump element in an axial direction thereof, said pump plate having, at its center, a shaft hole through which the driving shaft is inserted, and arc-shaped fuel inlet and outlet ports around the shaft hole; and a pump cover which covers the other end side of the pump element in the axial direction thereof and an outer periphery of the pump element in the radial direction thereof, said pump cover being combined with the pump plate in a liquid-tight manner, said pump cover being fastened to the housing side surface, together with the pump plate wherein said pump plate is provided with a rib that partitions at least one of the inlet and outlet ports in a circumferential direction thereof, and couples the opposite sides of the port, a space between the inlet and outlet ports and the shaft hole is imperforate, and the pump cover is fastened at an outside flange of the pump cover by threaded fasteners to the pump plate such that the pump cover covers said other end side of the pump element which is opposite to the pump plate and covers the radially outer side periphery of the pump element.

2. A fuel injection pump according to claim 1, wherein the rib is provided at a center of said at least one of the ports, in the circumferential direction thereof.

* * * * *